US006676806B1

(12) United States Patent
Butt, Sr.

(10) Patent No.: US 6,676,806 B1
(45) Date of Patent: Jan. 13, 2004

(54) PROCESS FOR INCREASING THE WET STRENGTH OF POROUS PLUG WRAPS FOR USE IN SMOKING ARTICLES

(75) Inventor: Jon R. Butt, Sr., Woodstock, GA (US)

(73) Assignee: Schweitzer-Mauduit International, Inc., Alpharetta, GA (US)

( * ) Notice: Subject to any disclaimer, the term of this patent is extended or adjusted under 35 U.S.C. 154(b) by 165 days.

(21) Appl. No.: 09/685,239

(22) Filed: Oct. 10, 2000

Related U.S. Application Data

(62) Division of application No. 09/134,204, filed on Aug. 14, 1998, now abandoned.

(51) Int. Cl.[7] ..... D21H 27/00

(52) U.S. Cl. ..... 162/139; 162/168.1; 162/158; 131/365; 131/362

(58) Field of Search ..... 131/365, 360, 131/361, 362, 336, 280, 284, 331, 332; 162/139, 168.1, 158

(56) References Cited

U.S. PATENT DOCUMENTS

| | | | | |
|---|---|---|---|---|
| 2,785,067 A | * | 3/1957 | Osberg, Jr. | 162/158 |
| 3,006,806 A | | 10/1961 | Schur | |
| 3,483,077 A | | 12/1969 | Aldrich | |
| 3,608,564 A | | 9/1971 | Takahashi et al. | |
| 3,705,588 A | | 12/1972 | Tamol et al. | |
| 4,407,994 A | | 10/1983 | Bankert et al. | |
| 4,510,950 A | | 4/1985 | Keritsis et al. | |
| 4,522,686 A | | 6/1985 | Dumas | |
| 4,607,647 A | | 8/1986 | Dashley et al. | |
| 4,919,724 A | | 4/1990 | Cenisio et al. | |
| 5,013,775 A | | 5/1991 | Oikawa et al. | |
| 5,019,262 A | | 5/1991 | Wang | |
| 5,102,502 A | * | 4/1992 | Reinhardt et al. | 162/135 |
| 5,107,866 A | | 4/1992 | Aronoff et al. | |
| 5,143,099 A | | 9/1992 | Le Gars et al. | |
| 5,190,584 A | | 3/1993 | Ruffini | |
| 5,281,307 A | | 1/1994 | Smigo et al. | |
| 5,397,436 A | | 3/1995 | Robeson et al. | |
| 5,439,010 A | | 8/1995 | Ross | |
| 5,484,509 A | | 1/1996 | Famili et al. | |
| 5,692,525 A | * | 12/1997 | Counts et al. | 131/194 |

FOREIGN PATENT DOCUMENTS

| | | |
|---|---|---|
| GB | 1457428 | 12/1976 |
| JP | 58120680 | 7/1983 |

OTHER PUBLICATIONS

Smook, Hanbook for Pulp and Paper Technologists, 2nd. Ed., 1992, Angus Wilde Publications, Inc., pp. 223–224.*

* cited by examiner

*Primary Examiner*—Dionne A. Walls
(74) *Attorney, Agent, or Firm*—Dority & Manning, P.A.

(57) ABSTRACT

A process for increasing the wet tensile strength properties of a porous plug wrap paper for use in smoking articles is disclosed. The wet strength properties of the paper are increased by incorporating into the paper an alkyl ketene dimer and by applying a size containing polyvinyl alcohol to a surface of the paper. The wet strength properties of the paper can be increased without using cross-linking agents. Porous plug wrap papers made in accordance with the present invention can have a wet tensile strength retention of at least 20%.

13 Claims, 1 Drawing Sheet

PROCESS FOR INCREASING THE WET STRENGTH OF POROUS PLUG WRAPS FOR USE IN SMOKING ARTICLES

RELATED APPLICATIONS

The present application is a divisional application of U.S. Ser. No. 09/134,204 filed on Aug. 14, 1998 now abandoned.

FIELD OF THE INVENTION

The present invention is generally directed to a process for increasing the wet tensile strength of highly porous paper, such as porous plug wraps used in the construction of smoking articles. More particularly, the present invention is directed to a process for increasing the wet strength of porous plug wraps by adding a ketene dimer to a pulp fiber suspension during formation of the paper in combination with adding polyvinyl alcohol to the surface of the paper after the paper has formed.

BACKGROUND OF THE INVENTION

Smoking articles such as cigarettes are conventionally made by wrapping a column of tobacco in white wrapping paper. At one end, the smoking article usually includes a filter through which the article is smoked. Filters are attached to smoking articles using a tipping paper which is glued to the white wrapping paper. Although there are some exceptions, conventional filters are typically formed from either compressed strips of paper or from cellulose acetate tows. Between the filter material and the tipping paper exists a porous plug wrap that holds the filter together prior to attachment to the wrapped column of tobacco.

The paper components used to produce smoking articles not only provide structure but also contribute to or control many physical properties and characteristics of the cigarette. For instance, the paper can be used to control the rate at which the cigarette burns, the number of puffs per cigarette, and the total tar delivery per puff. Many of the above properties are controlled by producing paper with a particular permeability.

For instance, porous plug wraps are lightweight papers that have a very high porosity and permeability. In particular, porous plug wraps are produced with high permeabilities so that they do not interfere with the burn characteristics of the smoking article as is more appropriately controlled by the cigarette wrapping paper and the tipping paper.

Unfortunately, since plug wraps need to have a very high porosity, plug wraps have relatively low strength which presents problems during formation of the paper and during formation of the smoking article.

For instance, during the formation of smoking articles, adhesive glue is typically applied to the porous plug wrap paper to serve as anchor lines for the cylindrical filter tow. The adhesive can wet the paper where applied and can thus reduce the strength of the paper. It is important that the paper is strong enough to withstand the forces that are being exerted on it, especially from the compacted filter tow.

The plug wrap material is folded tightly to encompass the rod of tow material. Specifically, the resulting plug wrap rod is passed through a garniture which brings the rod to the desired diameter. After the filter tow is wrapped by the plug wrap paper, the filter is then subjected to heat in order to dry the paper and the adhesive. Subsequently, the filter is cooled. During this step in the manufacturing procedure, another problem experienced during the formation of the filter is that during cooling, the filter tow and the plug wrap paper can pick up condensation. The condensation weakens the paper and can cause the plug wrap to expand. This expansion coupled with the loss of strength of the porous plug wrap paper can cause failure in production due either to circumference variation or a complete breach in the plug wrap.

In view of the above potential problems and difficulties that are experienced during the production of cigarette filters, in the past those skilled in the art have attempted to either increase the strength of porous plug wraps or make the porous plug wraps more moisture resistant. For instance, sizing agents have been applied to plug wraps in the past in order to increase the amount of water the porous paper can withstand or "hold out" during exposure to moisture. This method does increase the wet tensile strength of the plug wrap, but it does not increase it to a level sufficient enough to completely eliminate failures during production. Also in the past, strength enhancing agents have been applied to the porous paper. Examples of such agents include some cross-linking agents and wet strength resins. Unfortunately, these additional agents have recently come under environmental scrutiny in various countries.

Thus, a need still remains for a plug wrap paper for smoking articles that has improved wet tensile strength characteristics. Also, a need exists for a method of producing such plug wrap paper. A need also exists for a process that not only improves the "hold out" of plug wraps during exposure to moisture but also increases the wet tensile strength of the porous plug wraps. A need further exists for a method of increasing the wet tensile strength of plug wraps without the addition of cross-linking agents and certain wet strength resins.

SUMMARY OF THE INVENTION

The present invention recognizes and addresses the foregoing disadvantages, and others of prior art constructions and methods.

In general, the present invention is directed to a process for increasing the wet tensile strength of porous plug wrap paper used in the construction of smoking articles. The wet tensile strength of the plug wrap paper is increased by the addition of a ketene dimer composition in conjunction with a polyvinyl alcohol size. Through this process, the wet tensile strength of the plug wrap paper can be increased without the addition of cross-linking agents. As will be described in more detail hereinafter, the method of the present invention can be used to automatically increase the wet tensile strength as the porous plug wrap paper is being made.

Accordingly, it is an object of the present invention to provide an improved method of increasing the wet tensile strength of porous plug wraps.

Another object of the present invention is to provide a method for increasing the wet tensile strength of plug wraps while eliminating the addition of cross-linking agents and/or certain wet strength resins.

It is another object of the present invention to provide a method for automatically increasing the wet tensile strength of a porous plug wrap paper as the paper is being made.

These and other objects of the present invention are achieved by providing a process for increasing the wet tensile strength of porous plug wrap paper for a smoking article. The process includes the steps of incorporating a ketene dimer composition into the paper followed by applying a polymeric binder size, such as a polyvinyl alcohol size. The sequence of the additions is important to the enhancement of the wet tensile strength of the paper.

According to the present invention, the wet tensile strength of porous plug wrap paper can be increased above conventional plug wraps without the use of a cross-linking agent and/or wet strength agents that have recently fallen under environmental scrutiny. In particular, plug wrap papers made in accordance with the present invention have demonstrated a wet tensile strength retention greater than 20% and more particularly between about 20% to 35%. The basis weight of the porous plug wrap can be between about 10 $g/m^2$ to about 40 $g/m^2$ and more particularly between about 15 $g/m^2$ to about 25 $g/m^2$. For most applications, a plug wrap can be formed having a permeability, for instance, no less than 600 Coresta units and more preferably over 3000 Coresta units.

The ketene dimer composition and polymeric binder size added to the plug wrap paper can be an alkyl ketene dimer and polyvinyl alcohol respectively.

In one embodiment, the alkyl ketene dimer can be added in an amount from about 0.00001% to about 1% by weight based upon the weight of fiber contained in the paper. The polyvinyl alcohol can be a non-borated polyvinyl alcohol added in an amount from about 0.5% to about 15% by weight.

These and other objects of the present invention are also achieved by providing a process for increasing the wet tensile strength of porous plug wrap paper as the paper is being made. The system includes a paper forming device to form a continuous sheet of paper from a fiber suspension. The alkyl ketene dimer is added at the wet end of the papermaking process, specifically to the papermaking pulp slurry such as prior to the head box or at the head box. The polyvinyl alcohol is then added to the dry end of the papermaking process as a size press coating after a set of dryers.

Other objects, features and aspects of the present invention are discussed in greater detail below.

BRIEF DESCRIPTION OF THE DRAWINGS

A full and enabling disclosure of the present invention, including the best mode thereof, directed to one of ordinary skill in the art, is set forth more particularly in the remainder of the specification, including reference to the appended figures, in which.

Figure 1:
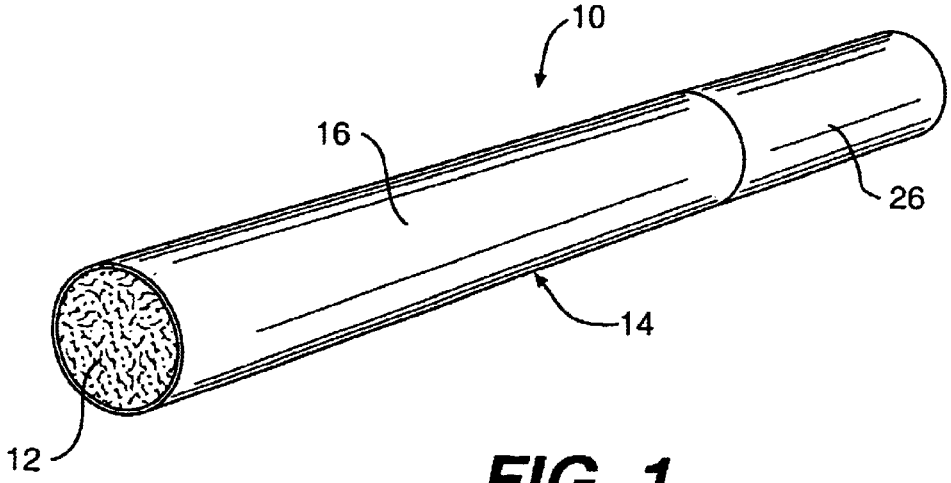
FIG. 1 is a perspective view of a conventionally made cigarette.

Repeat use of reference characters in the present specification and drawings is intended to represent same or analogous features of elements of the invention.

DETAILED DESCRIPTION OF THE PREFERRED EMBODIMENTS

It is to be understood by one of ordinary skill in the art that the present discussion is a description of exemplary embodiments only, and is not intended as limiting the broader aspects of the present invention which broader aspects are embodied in the exemplary construction.

The present invention is generally directed to a process for increasing the wet tensile strength of porous plug wrap paper used in the construction of smoking articles. The process includes the addition of a ketene dimer composition applied at the wet-end of the papermaking process followed by the addition of a polymeric binder at the dry-end of the papermaking process.

Porous plug-wrap paper made in accordance with the present invention not only has improved wet tensile strength, but is also made without using cross-linking agents or other ingredients that are currently being scrutinized as possibly being environmentally unfriendly. Wet tensile strength is measured in percent retention which is the percent of original tensile strength retained after the paper has been wetted. Porous plug wraps made in accordance with the present invention can have a wet tensile strength retention greater than 20% and even greater than 30% in some applications. For instance, thus far, porous plug wraps have been made having a wet tensile strength retention from about 20% to about 35%. Such high wet tensile strength retention properties allow for a decrease in the amount of diameter variation and/or complete breaching of the porous plug wrap during the production of smoking articles.

More particularly, porous plug wraps made in accordance with the present invention contain a ketene dimer, specifically an alkyl ketene dimer (AKD), in conjunction with a polymeric binder, specifically polyvinyl alcohol (PVA), in a manner that increases the wet tensile strength retention properties substantially above many conventional papers made in the past. According to the present invention, it has also been discovered that by incorporating a ketene dimer into the paper, the amount of polymeric binder that is applied to the paper can be substantially reduced, by as much as 50%. In particular, it has been discovered that papers containing an alkyl ketene dimer have decreased pick up levels of sizes that are subsequently applied to the paper. Of particular advantage, less size can be applied to the paper with the same resultant increases in strength as if conventional size levels are applied. Thus, the amount of polymeric binder that is applied to the paper is minimized while at the same time increasing the strength of the paper during processing. Further, it has also been discovered that the process of the present invention also decreases vertical capillary absorption.

Also of significant advantage, cross-linking agents such as glyoxal and wet strength resins such as epichlorohydrin resins are not needed in forming the paper and producing smoking articles. The termination of the above-described additional agents is believed to provide a more environmentally safe paper product.

Figure 2:
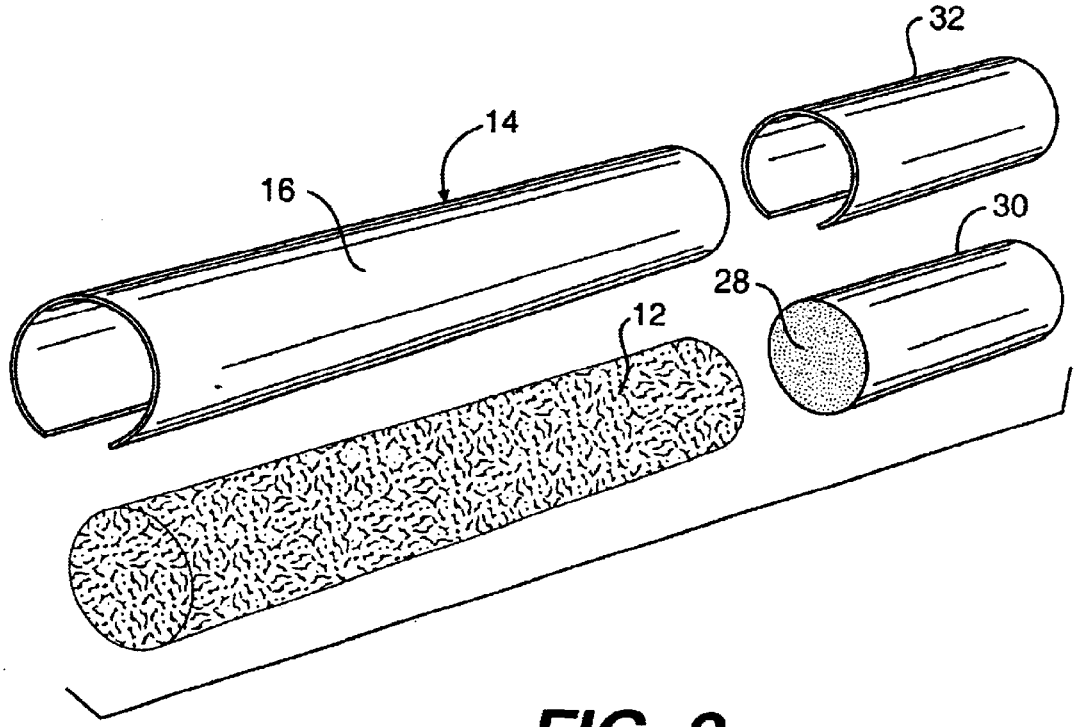
FIG. 2 is a perspective view illustrating the different components used to make a cigarette.

FIGS. 1 and 2 illustrate the components that are combined to form a smoking article, generally 10, having a tobacco column 12 within a wrapper 14. Wrapper 14 may include any manner of commercially available cigarette wrapper. Paper web 14 defines an outer circumferential surface 16 when wrapped around tobacco column 12.

Article 10 may also include a filter 26 that is made from compressed paper or cellulose acetate tows 28. Filter material 28 is held in a cylindrical form by a porous plug wrap paper 30. The filter material 28 encompassed by porous plug wrap 30 is attached to the tobacco column 12 using tipping paper 32 and an adhesive.

Different air permeability levels of wrapper 14, tipping paper 32, and porous plug wrap 30 contribute to the control of the burn rate and other physical characteristics of the smoking article. As described above, plug wrap 30 is generally made with a very high permeability so as to not substantially interfere with the effects that wrapper 14 and tipping paper 32 have on the characteristics and properties of the cigarette. Unfortunately, because plug wrap 30 should have a high permeability, the paper is relatively weak. The main purpose of the present invention is to provide a process for producing highly porous plug wraps that have improved strength properties, particularly wet tensile strength properties that facilitate production of the smoking article.

The wet strength enhancing agent of the present invention includes a ketene dimer and more particularly an alkyl ketene dimer. For instance, in one embodiment, "HERCON 79" from Hercules Limited is used, which is a commercially available slurry containing approximately 40% active solids. The AKD composition is added to the wet end of the paper manufacturing process when the pulp fibers are in an aqueous slurry. In particular, the AKD is added to the papermaking pulp slurry preferably prior to the head box and after the pulpers. The AKD can be added in an amount equivalent to 0.00001% to 1% by weight of the fiber. Preferably, the amount of AKD added is from about 0.05% to about 0.2% by weight of the fiber. It is believed that the addition of the AKD at the wet end during the appropriate time increases its effectiveness due to the longer resonance times.

The polymeric binder used in conjunction with the AKD according to the present invention is typically a polyvinyl alcohol, preferably a non-borated polyvinyl alcohol. For instance, one commercially available non-borated polyvinyl alcohol that may be used in the process of the present invention is marketed under the trade name EVANOL by DuPont. The non-borated PVA is effectively added to the dry end of the papermaking process separately from the wet end addition of AKD. Specifically, the non-borated PVA is preferably applied as a size press coating after that paper is fed through a dryer. The amount of PVA applied to the fibrous bonded sheet material can be from about 0.5% to about 15% by weight. Preferably, the PVA is applied to the paper in an amount of from about 1% to about 5% by weight. Thus far, synergistic results have been observed when using non-borated PVA in combination with the AKD as opposed to using borated PVA, although acceptable results have been obtained when using borated PVA.

The fibrous bonded sheet on which the non-borated PVA is applied is preferably a lightweight, porous material, having a finished basis weight of from about 10 g/m to about 40 g/m . Preferably the weight range for the sheet material is from about 15 g/m$^2$ to about 25 g/m . Air permeability or porosity of the fibrous bonded sheet is typically measured in Coresta units. In accordance with the present invention, the permeability of the plug wrap paper is at least 600 to 700 Coresta units and more preferably over 3,000 Coresta units.

It is believed that the application sequence of the PVA in conjunction with the AKD of this invention is particularly vital to the increase in wet tensile strength of the porous plug wrap. Preferably, the AKD is applied at the wet end of the papermaking process followed by the addition of the non-borated PVA at the dry end of the process. Furthermore, the present invention prefers the use of a non-borated PVA incorporated with AKD. It is believed that elimination of the boration reaction with the PVA allows the polymeric binder to react and bond with the AKD in the fibrous sheet material without the use of a cross-linking agent.

The present invention may be better understood with reference to the following examples.

EXAMPLE No. 1

The dry tensile strength, wet tensile strength, and percent wet tensile strength retention of different base sheets made with different additives were tested. In particular, porous plug wrap papers made in accordance with the present invention were tested and compared to plug wrap papers made according to different methods. In particular, porous plug wraps containing the following additives were tested:

| Sample | Additive |
|---|---|
| A | Non-coated |
| B | Non-coated with HERCON (from Hercules Limited) in Base Sheet |
| C | Coated with Borated PVA (from DuPont) |
| D | Coated with Non-Borated PVA |
| E | Coated with Borated PVA with HERCON in Base Sheet |
| F | Coated with Non-Borated PVA with HERCON in Base Sheet |

All of the base sheets listed above were made having a permeability rating of 6,500 Coresta units. Porous plug wrap papers were made incorporating the above-described additives and then subjected to machine direction (MD) and cross-machine direction (CD) stress in order to obtain the following results.

TABLE I

| | Dry Tensile(g/inch) | | Wet Tensile(g/inch) | | Retention % | |
|---|---|---|---|---|---|---|
| | MD | CD | MD | CD | MD | CD |
| A. | 1984 | 368 | 24 | 11 | 1.2 | 3.0 |
| B. | 1837 | 281 | 25 | 9 | 1.4 | 3.2 |
| C. | 3779 | 563 | 426 | 56 | 11.3 | 9.9 |
| D. | 4196 | 617 | 316 | 78 | 7.5 | 12.6 |
| E. | 2570 | 637 | 363 | 52 | 14.1 | 8.2 |
| F. | 3859 | 626 | 1385 | 224 | 35.9 | 35.8 |

As shown from the above results, Sample E and Sample F made in accordance with the present invention exhibited improved wet tensile strength retention properties in relation to the other base sheets. As also shown, the plug wrap paper made with the non-borated PVA (Sample F) had much better wet strength retention properties than the sample made with borated PVA (Sample E).

EXAMPLE No. 2

Base sheets having an air permeability measurement of 26,000 Coresta units were also constructed containing different additives. Each sample was compared with respect to dry tensile strength, wet tensile strength, and percent wet tensile strength retention. In this case, a cross-linking agent was utilized as one of the additives in order to observe the results. In particular, the following samples were constructed.

| Sample | Additive |
|---|---|
| A | Non-coated |
| B | Coated with Borated PVA (from DuPont) |
| C | Coated with Non-Borated PVA (from DuPont) and a glyoxal mix (cross-linking agent) |
| D | Coated with Non-Borated PVA with HERCON(from Hercules Limited) in Base Sheet |

As shown above, Sample D was made in accordance with the present invention, while Sample C contained a cross-linking agent. As in the previous example, porous plug wraps were made incorporating the above-described additives and then subjected to machine direction (MD) and cross-machine direction (CD) stress in order to obtain the following results.

TABLE II

| | Dry Tensile(g/inch) | | Wet Tensile(g/inch) | | Retention % | |
|---|---|---|---|---|---|---|
| | MD | CD | MD | CD | MD | CD |
| A. | 2307 | 651 | 184 | 81 | 8.0 | 12.4 |
| B. | 3546 | 1603 | 278 | 119 | 7.8 | 7.4 |
| C. | 4146 | 1153 | 774 | 201 | 18.7 | 17.4 |
| D. | 3956 | 1129 | 1309 | 337 | 33.1 | 29.8 |

As shown above, Sample D made in accordance with the present invention exhibited superior wet tensile strength retention properties in comparison to the other samples including the sample containing the cross-linking agent.

These and other modifications and variations to the present invention may be practiced by those of ordinary skill in the art, without departing from the spirit and scope of the present invention, which is more particularly set forth in the appended claims. In addition it should be understood that aspects of the various embodiments may be interchanged both in whole or in part. Furthermore those of ordinary skill in the art will appreciate that the foregoing description is by way of example only, and is not intended to limit the invention so further described in such appended claims.

What is claimed is:

1. A process for increasing the wet strength properties of a plug wrap paper comprising the steps of:

providing a pulp slurry containing pulp fibers in an aqueous suspension;

adding a wet strength enhancing agent to said pulp slurry, said wet strength enhancing agent consisting essentially of a ketene dimer;

forming said pulp slurry into a paper; and applying a size composition to a surface of said paper, said size composition comprising polyvinyl alcohol, said polyvinyl alcohol in conjunction with said ketene dimer increasing the wet strength of said plug wrap paper, wherein said formed paper has a permeability of over 600 Coresta units.

2. A process as defined in claim 1, wherein said ketene dimer comprises an alkyl ketene dimer.

3. A process as defined in claim 1, wherein said polyvinyl alcohol comprises a non-borated polyvinyl alcohol.

4. A process as defined in claim 1, wherein said ketene dimer is added to said pulp slurry in an amount up to about 1% by weight based on the weight of fibers contained within said slurry.

5. A process as defined in claim 4, wherein said size composition is added to said paper in an amount from about 0.5% to about 15% by weight.

6. A process as defined in claim 5, wherein said ketene dimer is added to said pulp slurry in an amount from about 0.05% to about 0.2% by weight based upon the weight of fibers contained in said slurry.

7. A process as defined in claim 4, wherein said size composition is applied to said paper in an amount from about 1% to about 5% by weight.

8. A process as defined in claim 1, wherein said wet strength enhancing agent and said size composition are added to said paper in an amount sufficient for said paper to have a wet tensile strength retention of at least 20%.

9. A process for increasing the wet strength properties of a plug wrap paper used for wrapping filters for smoking articles, said process comprising the steps of:

providing a pulp slurry containing pulp fibers in an aqueous suspension;

adding a wet strength enhancing agent to said pulp slurry, said wet strength enhancing agent consisting essentially of an alkyl ketene dimer;

forming said pulp slurry into a paper; and applying a size composition to a surface of said paper, said size composition containing polyvinyl alcohol, said size composition in conjunction with said alkyl ketene dimer increasing the wet strength of said paper, wherein said paper has a basis weight of from about 10 $g/m^2$ to about 40 $g/m^2$ and has a permeability of at least 600 Coresta units.

10. A process as defined in claim 9, wherein said alkyl ketene dimer is present in said pulp slurry in an amount up to about 1% by weight based upon the weight of fibers contained in said slurry.

11. A process as defined in claim 9, wherein said polyvinyl alcohol comprises a non-borated polyvinyl alcohol.

12. A process as defined in claim 11, wherein said sizing composition is applied to said paper in an amount from about 1% to about 5% by weighs.

13. A process as defined in claim 9, wherein said formed paper has a permeability of at least 3,000 Coresta units.

* * * * *

UNITED STATES PATENT AND TRADEMARK OFFICE

CERTIFICATE OF CORRECTION

PATENT NO. : 6,676,806 B1
DATED : January 13, 2004
INVENTOR(S) : Jon R. Butt, Sr.

It is certified that error appears in the above-identified patent and that said Letters Patent is hereby corrected as shown below:

Column 8,
Line 44, "weighs" should read -- weight --

Signed and Sealed this

Twenty-first Day of June, 2005

JON W. DUDAS
*Director of the United States Patent and Trademark Office*